US005423164A

United States Patent [19]

Schneider

[11] Patent Number: 5,423,164

[45] Date of Patent: Jun. 13, 1995

[54] GRAB SADDLE

[76] Inventor: John R. Schneider, 4 Woodside Dr. East, Apalachin, N.Y. 13732

[21] Appl. No.: 210,940

[22] Filed: Mar. 21, 1994

[51] Int. Cl.[6] ..... B68C 1/02

[52] U.S. Cl. ..... 54/44.1; 54/66

[58] Field of Search ..... 54/44.1, 44.7, 66; 5/922; 24/442, 443; 297/464

[56] References Cited

U.S. PATENT DOCUMENTS

| | | | |
|---|---|---|---|
| 2,128,159 | 8/1938 | Morgan | 54/44.1 X |
| 3,897,611 | 8/1975 | Booth et al. | 24/628 |
| 4,457,510 | 7/1984 | Pertschuk | 128/DIG. 15 X |
| 4,910,818 | 3/1990 | Grabill et al. | 5/650 |
| 5,029,434 | 7/1991 | Erickson | 54/44.1 |
| 5,232,267 | 8/1993 | DeMatteo et al. | 297/464 X |

FOREIGN PATENT DOCUMENTS

| | | | |
|---|---|---|---|
| 2633916 | 1/1990 | France | 54/23 |

*Primary Examiner*—Robert P. Swiatek

[57] ABSTRACT

A device to secure the rider of a horse or other beast of burden to the animal without the need for a rigid saddle. This device also prevents the rider's bouncing when riding the animal. The preferred embodiment of this invention utilizes a strong fabric such as canvas or wool to form a blanket that covers the horse's back and sides and is strapped to the horse by attached strapping so it holds its position on the horse at all times. Sewed to this blanket in a central position are hook and loop fastener strips whose second, mating half strips are likewise sewn to the rider's pants or chaps so they are opposite the hook and loop fastener strips on the horse's blanket and mate with them when the rider is astride the horse. A disengaging device, which can interrupt the hook and loop fastener strip's bonding, is also provided to allow the rider to separate the fastener strips before leaving the horse.

14 Claims, 2 Drawing Sheets

GRAB SADDLE

BACKGROUND OF THE INVENTION

To date, the common means of remaining on a horse while riding has been the use of a leather saddle constructed over a wooden and metal frame which, when secured to a horse provides the rider a seat. These saddles are heavy and provide no device for relieving the rider's muscular burden of maintaining a proper riding position on the horse while the horse is in motion. The inevitable bouncing up and down of the rider is very taxing for both the rider and the horse. This invention provides a means of eliminating the rider's bounce and significantly reduces the weight a horse needs to carry since the saddle, as such, is eliminated.

SUMMARY OF THE INVENTION

It is an object of the present invention to produce a device for horseback or other animal riding that holds the rider firmly to the animal in a proper riding position and eliminates the rider's bouncing while the horse is in motion.

It is a further object of the invention to provide a simple means of quickly disengaging the rider from this device when dismounting the horse or separating the rider from the horse in an emergency.

It is another object of this invention to eliminate the need for present day saddles and so to significantly lighten the load a horse, or a person placing a saddle on a horse, has to carry.

DESCRIPTION OF THE PREFERRED EMBODIMENTS

Figure 1:
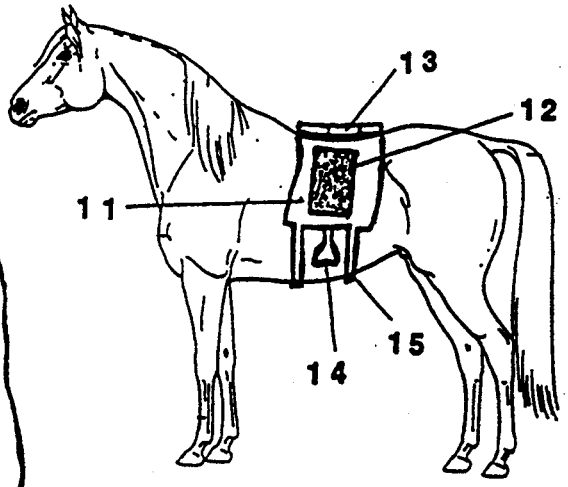
FIG. 1 is a view of a horse wearing the cover or blanket described which exhibits the hook and loop fastener strips attached to both sides of the cover.

Referring now to the drawings wherein like reference characters indicate like parts in the several views, there is shown in FIG. 1 the horse's cover or blanket 11, the hook and loop fastener's looped strips 12 and the rider's cushion 13 which together comprise the standard equipment on the horse's cover 11. The hook and loop fastener flexible fabric strips 12, which contain the loops, and 16 which contain the hooks, are stitched respectively to the horse cover 11 and the rider's pants

17 in opposite and parallel positions so that the strips 12 and 16 are located opposite each other when the rider sits the horse and may contact each other when the rider presses their legs against the sides of the horse. These hook and loop fasteners 12 and 16 could be located at any site on the horse cover or rider's pants which repositioning would be done to allow for side saddle riding for example. The rider's hook fastener strips 16 could also be mounted to strap on riding chaps rather than to the rider's pants.

Two other required parts of the horse cover assembly which are shown are the stirrup 14 and the cinch straps 15. These items are standard with horse saddles currently in use and are not novel to this invention. The materials used to fabricate the various parts of the horse cover assembly can vary such as with leather, canvas, wool, cotton, rubber, plastic and synthetic composite materials etc. all of which are good candidates for such use. The methods of bonding or sewing the various parts of the invented assemblies together is also open to the many successful techniques commonly used for such arts and no intention is here made to limit these means of construction possible.

Figure 2:
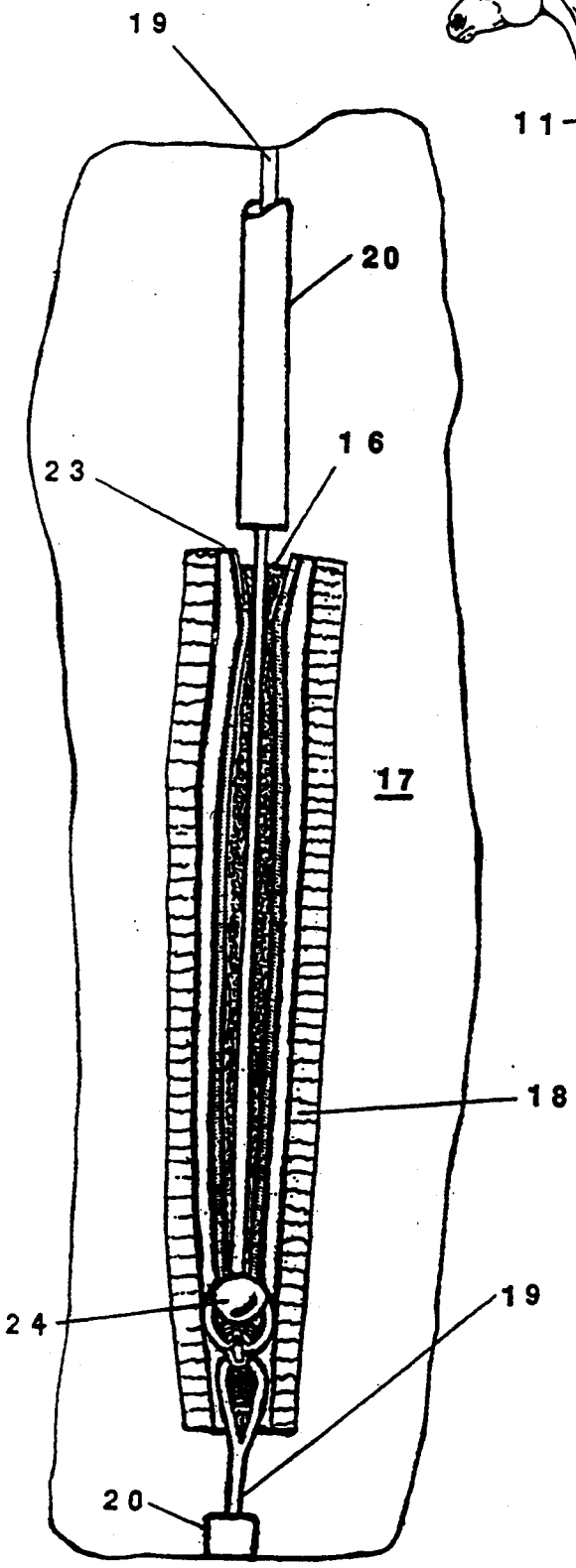
FIG. 2 is a view of the inside seam on the leg of the rider's pants which shows the zipper, elastic and hook and loop fastener assembly that mates with the hook and loop fastener strip on the cover of a horse equipped with this invention's horse cover.

FIG. 2 shows the other half of the hook and loop fastener strip 16. This half of the fastener is the strip which holds the hooks. It is shown in position on the inside of the legs of the rider's pants 17 but it could also be placed elsewhere on the rider's pants, or on riding chaps the rider would strap on. The reverse of this positioning of the hook and loop fasteners would be equally acceptable where the hook fastener, item 16 would be placed on the horse's cover while the loop fastener, item 12 would be placed on the rider's pants since it is of little consequence which half is attached to the rider and which half is attached to the horse. Secured by sewing to the pants and over top of the hook strips is a zipper 23. It may be augmented with an elastic mounting fabric 18 bridging between the fabric of the riding pants and the fabric of the zipper 23. This elastic mounting fabric 18 would be utilized to allow more of the covered hook fastener material to be exposed when the zipper is opened. The action of the elastic will be to pull the zipper open further when its two halves are disengaged thereby exposing a wider expanse of the hooked strip of fastener fabric. The pull line 19 which allows the rider to manipulate the zipper's head to open or close the zipper 23 without actually needing to grasp the zipper's head ring can be constituted by a short loop of line several inches long such as a leather thong tied through the ring on the zipper's head to allow the rider to grasp the leather thong to pull the zipper's head one way or the other.

Figure 4:
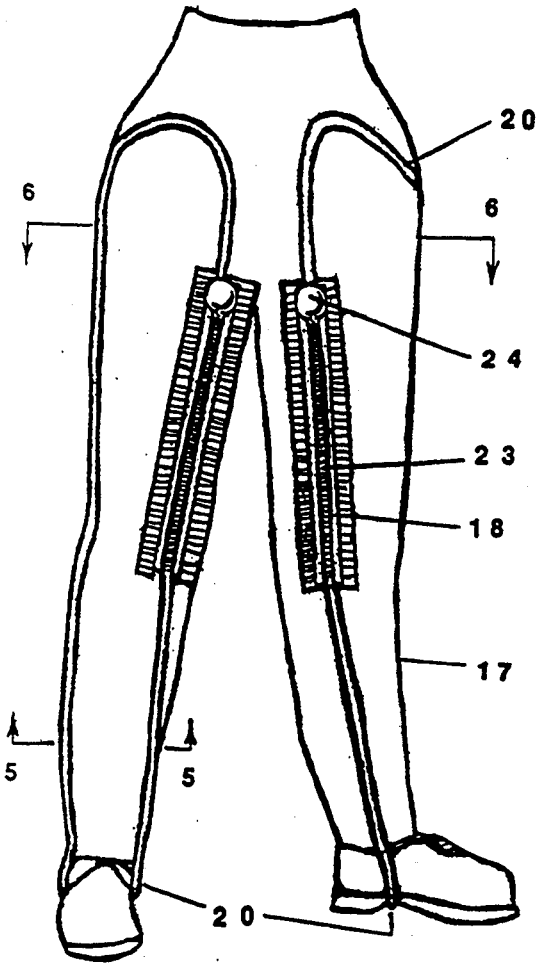
FIG. 4 is a view of the whole body of the rider from the waist down wearing the riding pants as modified with this invention's embodiments and showing the route of the pull line inside the guide tube attached to the pants with fabric covers or other suitable means which enclose the plastic tubes that guide the pull line around the rider's legs and to the zipper's head or heads.
Figure 5:
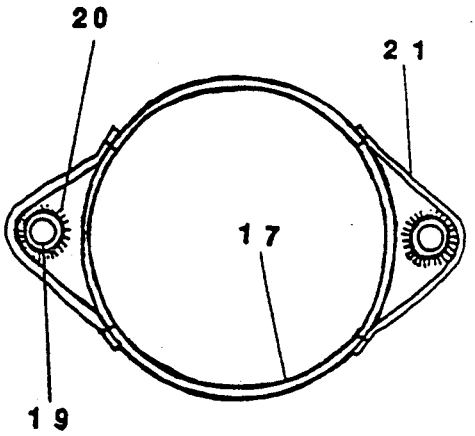
FIG. 5 is a sectional view on an enlarged scale taken on line 5—5 of FIG. 4.
Figure 6:
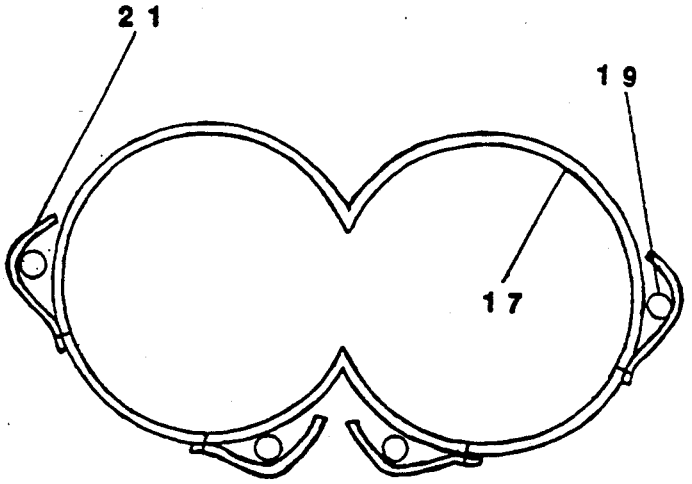
FIG. 6 is a sectional view on an enlarged scale taken on line 6—6 of FIG. 4.

As an alternative, the pull line 19 can be much more complex than just a simple leather loop and can be designed to traverse the entire length of the rider's leg as shown in FIG. 4. This pull line is also shown in FIG. 2 to be threaded through a bulbous projection 24 made of plastic or wood or other suitable material that is secured on the pull line immediately ahead of the zipper's head to which the pull line is attached. The zipper head is forced to interdict between the two halves of the hook and loop fastener strips as the pull line is pulled to close the zipper. This disengages the hook and loop strips one from the other and the bulbous projection facilitates this separating action by pushing the two fastener strips further apart as it moves between them. Opening the zipper exposes the hooked fastener strip 12 which can then be pressed against the looped section of fastener strip 16 to secure the two together. It is also apparent to one skilled in this art that multiple shorter zippers could be employed in line one above the other rather than one long zipper to cover the hooked strip. When these zippers were all attached in series with one another on the same pull line it would result in a reduction of the distance the pull line needed to be pulled to effect the complete disengagement of the fastener strips. The pull line in FIG. 5 is also shown to be threaded through a guide tube 20 made of plastic or other such material useful for the purpose so as to guide the energy imparted to the pull line by the rider's hand more efficiently to open or close the zipper at will. The guide tube 20 is in turn enclosed in a protective sheath 21 made of the same fabric from which the riding pants are made and stitched to the riding pants 17 on both sides of the guide tube 20. This protective sheath 21 prevents the guide tubes from being exposed and snagged by projections which may brush past the rider's pants. One possible, but not exclusive, routing for this guide tube and its enclosed pull line would have it travel down the inside of the rider's leg, across the instep of the rider's foot just ahead of the heel on the outside of the rider's boot and then up the other side of the leg as shown in FIG. 4. The pull line inside the guide tube can form a complete loop by joining the other end of itself at the top of the rider's leg to make an endless circuit of the rider's leg. The pull line thus housed inside the guide tube for most of its circuit will be guided inside the guide tube when the line is pulled by the rider. As shown in FIG. 6 the exposed portion of the pull line 19 which is not enclosed by the guide tube 20 at the top of the inside and outside of the rider's leg will allow access to pull the line so it may be pulled in either direction. The pull line will exit the guide tube at several points along its routing to facilitate the rider's access to pulling it. Where it is exposed, the pull line as shown in FIG. 6 is covered with a flap of fabric 21 to prevent snagging of the pull line with external foreign objects. A second zipper head located on the same zipper can be positioned and locked in place to limit the travel of the first zipper head on that zipper. This will effectively block the first zipper head from opening the zipper any farther than the second zipper head's position on the zipper. This will effect a means of adjusting the extent to which the zipper can be opened and therefor also the amount of hook and loop fastener area that the open zipper is exposing to contact with its mating second half of hook and loop material. This limiting feature is for the purpose of regulating the amount of force necessary to disengage the hook and loop fastener material should there be the need for an unaided release of the rider from the horse in some emergency for example. This would allow a force only slightly greater than the force exerted by the normal riding actions to effect an immediate separation between rider and horse since only slightly more hook and loop fastener material would be engaged than that amount necessary to hold that weight rider onto the horse during normal riding events. If the horse should fall, the rider who has properly adjusted this second zipper head and locked it in place will automatically break away from contact with the horse as desired without the rider needing to try to operate the zipper to disengage the hook and loop fastener material. As shown in FIG. 1 there is a foam or air cushion 13 attached to the top of the horse's cover and situated under the rider for the rider's comfort during the ride. The rider would sit on this cushion while in riding position on the horse.

Figure 3:
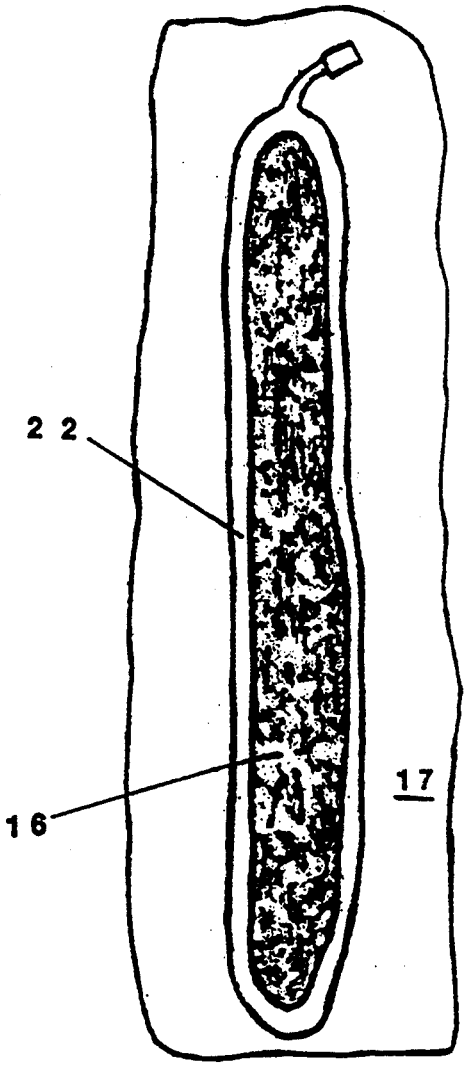
FIG. 3 is a view, like FIG. 2, except showing an air inflated disengaging device as an alternate method to the preferred zipper disengaging device shown in FIG. 2.

FIG. 3 shows the placement of an inflated air tube 22 of a configuration such as the tire tube for a bicycle. It is only one of many possible alternate methods that could be used to disengage the halves of the hook and loop fastener strips one from the other if the preferred zipper method described above was not employed. This air tube would be inflated by one of several methods such as a hand pump or compressed gas cartridge etc. to effect the separation of the two halves of the hook and loop fasteners and allow the rider to leave the horse.

FIG. 4 shows the whole embodiment of the rider's pants assembly with pull lines 19 in their guide tubes 20 in evidence on both legs of the riding pants 17. Each of the two pull lines is completely separate from one another. The rider must pull each leg's pull line separately to effect a complete separation of both legs from the horse before dismounting the horse. Otherwise, although it would be less convenient, the rider might elect to disengage from the horse simply by forcing the hook and loop fasteners apart using their muscles to do so. The zipper can be closed after dismounting simply to cover the hooks on that fastener strip so they do not pose a constant hooking problem with extraneous materials the rider may contact while wearing the pants dismounted.

FIG. 5 shows in cross section the attachment of the pull line 19, the guide tube 20 and the protective sheath 21 to the riding pants 17. The protective sheath may be made from the same material as the riding pants and has as its purpose the securing of the guide tube into its preferred position on the outside of the rider's pants. It also protects the guide tube from being snagged by foreign matter passing by the rider's pants.

FIG. 6 shows in cross section the pull line 19 as it would be covered by the protective sheath 21 to keep it from snagging in areas where it is not inside the guide tube because the rider is expected to be able to grasp the pull line at that point and move it back or forth to impart the same motion to the zipper's head. To allow the rider to grasp the pull line, it must be outside the guide tube 20 and so needs some covering such as the protective sheath 21 to protect it from snagging.

It is simple to design this system in the reverse of that shown in FIGS. 1–4 so that the hooked half of the fastener strips is mounted on the horse's cover rather than on the rider's pants. In this configuration there would be no need for anything to be mounted on the rider's pants except the loop portion of the fastener strips. The zipper and its pull line etc. would be located over the hooked portion of the fastener strips on the horse's cover instead of on the rider's pants.

It is obvious that if some riders would rather still use the current day rigid saddles made with wood and metal frames that these saddles could also be fitted with this invention's various features for the purpose of keeping the rider from bouncing during their ride.

I claim:

1. A grab saddle assembly for securing a rider to a horse or other beast of burden comprising:

a cover secured over an animal's back and sides;

at least one loop fastener strip attached to said animal's cover;

at least one hook fastener strip attachable to the rider's pants or chaps for engagement with said at least one loop fastener strip;

disengagement means secured over the top of said at least one hook fastener strip for separating said at least one loop and hook fastener strips from one another; and a cushion secured to said animal cover under said rider, so that said rider sits upon said cushion while riding said animal.

2. The grab saddle assembly of claim 1, wherein said disengagement means comprises a zipper equipped with a head ring.

3. The grab saddle assembly of claim 2, wherein said zipper has attached to its head ring a bulbous projection.

4. The grab saddle assembly of claim 2, wherein said zipper is securable to said rider's pants or chaps utilizing elastic mounting strips which strips span the entire length of both sides of said

5. The grab saddle assembly of claim 2, further comprising a pull line, the first end of which is attached to a first side of a head ring of said zipper and the second end of which pull line is attached to the opposite end of said zipper head so that said zipper head is moved by tension on opposite ends of said pull line.

6. The grab saddle assembly of claim 5, further comprising a pull line guide tube which guide tube houses said pull line and which guide tube is held to said rider's pants or chaps by a protective sheath covering said guide tube.

7. The grab saddle assembly of claim 1, wherein said disengagement means comprises an air tube.

8. A grab saddle assembly for securing a rider to a horse or other beast of burden comprising:

a cover secured over an animal's back and sides;

at least one hook fastener strip attached to said animal's cover;

at least one loop fastener strip attachable to the rider's pants or chaps to engage said at least one hook fastener strip;

disengagement means secured over the top of said at least one hook fastener strip for separating said at least one loop and hook fastener strips from one another; and a cushion secured to said animal cover under said rider, so that said rider sits upon said cushion while riding said animal.

9. The grab saddle assembly of claim 8, wherein said disengagement means comprises a zipper equipped with a head ring.

10. The grab saddle assembly of claim 9, wherein said zipper has attached to its head ring a bulbous projection.

11. The grab saddle assembly of claim 9, wherein said zipper is securable to said rider's pants or chaps utilizing elastic mounting strips which strips span the entire length of both sides of said zipper.

12. The grab saddle assembly of claim 9, further comprising a pull line, the first end of which is attached to a first side of a head ring of said zipper and the second end of which pull line is attached to the opposite end of the zipper head so that the zipper head is moved by tension on opposite ends of said pull line.

13. The grab saddle assembly of claim 12, further comprising a pull line guide tube which guide tube houses said pull line and which guide tube is held to said rider's pants or chaps by a protective sheath covering said guide tube.

14. The grab saddle assembly of claim 8, wherein said disengagement means comprises an air tube.

* * * * *